United States Patent [19]

Westover

[11] Patent Number: 4,669,721

[45] Date of Patent: Jun. 2, 1987

[54] SHEET TRANSPORT WITH BOWED GUIDE

[75] Inventor: Dwight G. Westover, Sierra Madre, Calif.

[73] Assignee: Bell & Howell Company, Skokie, Ill.

[21] Appl. No.: 854,177

[22] Filed: Apr. 21, 1986

[51] Int. Cl.[4] ..... B65H 5/02; B65G 15/00

[52] U.S. Cl. ..... 271/272; 271/161; 271/245; 271/274; 198/836

[58] Field of Search ..... 271/272, 274, 161, 188, 271/245, 246, 250, 251; 198/836, 628; 226/18

[56] References Cited

U.S. PATENT DOCUMENTS

| | | | |
|---|---|---|---|
| 1,786,343 | 12/1930 | Griffith . | |
| 2,028,236 | 1/1936 | Needham . | |
| 2,828,123 | 3/1958 | Guillemette . | |
| 3,052,467 | 9/1962 | Fertig . | |
| 3,661,383 | 5/1972 | Morrison | 271/51 |
| 3,861,516 | 1/1975 | Inose et al. | 198/35 |
| 3,966,188 | 6/1976 | Maguire | 271/251 X |
| 3,998,453 | 12/1976 | Dorer | 271/272 |
| 4,163,491 | 8/1979 | Rock et al. | 198/836 |
| 4,200,016 | 4/1980 | Helmig et al. | 83/88 |
| 4,350,332 | 9/1982 | Knight | 271/188 |
| 4,362,298 | 12/1982 | Stefansson et al. | 271/236 |
| 4,431,179 | 2/1984 | Westover et al. | 271/274 |
| 4,514,799 | 4/1985 | Spencer | 364/200 |
| 4,533,135 | 8/1985 | Barker | 271/275 |

FOREIGN PATENT DOCUMENTS

| | | | |
|---|---|---|---|
| 2328483 | 1/1974 | Fed. Rep. of Germany | 271/245 |
| 2643906 | 3/1978 | Fed. Rep. of Germany | 271/272 |
| 637102 | 3/1962 | Italy | 198/628 |
| 0141333 | 9/1982 | Japan | 271/273 |

OTHER PUBLICATIONS

Xerox Disclosure Journal, vol. 3, No. 5, Sep./Oct. 1978, *Anti-Wrinkle Fuser.*

*Primary Examiner*—Joseph J. Rolla
*Assistant Examiner*—Gregory L. Huson
*Attorney, Agent, or Firm*—Benoit Law Corporation

[57] ABSTRACT

Sheet transporting apparatus and methods provide an elongate guide for the sheet in contact with the drive belt. The guide is bowed along an arc extending into the transport path in parallel to the direction of sheet transport. The drive belt is bowed by that guide and is driven along the path for moving the sheet along the bowed guide. The sheet guide may also be tilted on an axis extending in the direction of sheet transport. Preferably, the sheet guide is tilted by different angular amounts at different points along the transportation path to provide a skew adjustment for the traveling sheet.

35 Claims, 5 Drawing Figures

SHEET TRANSPORT WITH BOWED GUIDE

BACKGROUND OF THE INVENTION

1. Field of the Invention

The subject invention relates to methods and apparatus for transporting checks, billing stubs, papers, documents and other sheets, and to sheet feeder systems.

2. Information Disclosure Statement

The following disclosure statement is made pursuant to the duty of disclosure imposed by law and formulated in 37 CFR 1.56 (a). No representation is hereby made that information thus disclosed in fact constitutes prior art, inasmuch as 37 CFR 1.56 (a) relies on a materiality concept which depends on uncertain and inevitably subjective elements of substantial likelihood and reasonableness and inasmuch as a growing attitude appears to require citation of material which might lead to a discovery of pertinent material though not necessarily being of itself pertinent. Also, the following comments contain conclusions and observations which have only been drawn or become apparent after conception of the subject invention or which contrast the subject invention or its merits against the background of developments which may be subsequent in time or priority.

U.S. Pat. No. 4,533,135, issued Aug. 6, 1985, for a jammed sheet removal aid in a reproducing machine, by Laurence S. Barker, discloses a sheet transport including a number of endless belts each having a metal strip in juxtaposition therewith for securing advancing sheets to the associated belt. Each metal strip has an upturned portion at an end thereof and is releasable to a spaced condition from the associated belt, whereby a jammed sheet may readily be removed from the transport system.

U.S. Pat. No. 3,998,453, issued Dec. 21, 1976, for sheet conveyor apparatus, by Wilfried Dorer, discloses a sheet conveyor including an endless belt having a lower run. Coacting with that lower run is a series of rotatable guides having their axes of rotation located on a common arc.

U.S. Pat. No. 3,861,516, issued Jan. 21, 1975, for apparatus for feeding sheets into a punching machine, by Tadao Inose et al, discloses an array of rollers pressing against the sheet carrying surfaces of conveyor belts. A frame, which carries the rollers, is pivotally mounted for movement between engaged and disengaged positions.

U.S. Pat. No. 1,786,343, issued Dec. 23, 1930, for a universal drag conveyor, by Francis Griffith, proposed the use of bent and twisted channels or troughs for transporting sheets with the aid of conveyor belts.

U.S. Pat. No. 3,661,383, issued May 9, 1972, for document handling apparatus, by Douglas I. Morrison, discloses curved sheet guide plates.

U.S. Pat. No. 2,028,236, issued Jan. 21, 1936, to John T. Needham, disclosed a conveyor system in which sheets were dragged by conveyor belts along ribbed metal guides having downturned sheet entry and exit portions.

U.S. Pat. No. 2,828,123, issued Mar. 25, 1958, for feed roll sheet feeding apparatus, by Delphis V. Guillemette, disclosed the provision of a grate-like frame including rods or bars for preventing sheets from becoming lapped around adjaceht rollers and for removing static electricity from the sheets.

U.S. Pat. No. 4,362,298, issued Dec. 7, 1982, for angular-linear sheet transports, by Rafn Stefansson et al, discloses a system of pivotal wheels for driving sheets along supporting surfaces and into registry with a registration edge.

U.S. Pat. No. 4,514,799, issued Apr. 30, 1985, for Bus System Architecture and Microprocessor System, by William H. Spencer et al, discloses remittance processing terminals and other document handling systems in which sheets are transported among various data transfer and processing stations.

U.S. Pat. No. 4,431,179, issued Feb. 14, 1984, for transport channel systems, by Dwight G. Westover et al, discloses leaf springs for urging sheets into engagement with a conveyor belt, either via rollers engaging the sheets and having bearings mounted on the leaf springs, or through the formation of the leaf springs as resilient tracking elements engaging the sheets directly.

U.S. Pat. No. 4,200,016, issued Apr. 29, 1980, for sheet stacking apparatus, by Richard W. Helmig et al, discloses a convex wall guiding a conveyor belt carrying sheets at the outside thereof.

U.S. Pat. No. 3,052,467, issued Sept. 4, 1962, for stacker for intermixed documents of varying size, by Frank L. Fertig et al, discloses a document stacker system in which twisted guides direct documents diverted from the main feed path into stacker areas extending at acute angles thereto.

SUMMARY OF THE INVENTION

It is a general object of this invention to provide improved methods and apparatus for transporting sheets with drive belts.

It is a germane object of this invention to provide improved sheet transports in which the drive belt may continue to run without overloading the system, even when the sheet is being stopped in the transport path.

It is a related object of this invention to provide improved sheet transports which are adjustable for optimum contact of the sheet with a conveyor belt along the transport path.

Other objects of the invention will become apparent in the further course of this disclosure.

The subject invention resides in methods and apparatus for transporting a sheet with a drive belt in a predetermined direction along a path and, more specifically, resides in the improvement comprising, in combination, the steps of, or means for, providing an elongate guide for the sheet in contact with the drive belt along the path, bowing the guide along an arc extending into the path in parallel to said predetermined direction and thereby bowing the drive belt, driving the bowed belt along the path and bowed guide, and feeding the sheet inbetween the bowed guide and belt for moving the sheet with the bowed drive belt in the path between the bowed guide and the bowed drive belt.

From a related aspect thereof, the subject invention resides in methods and apparatus for transporting a sheet with a drive belt in a predetermined direction along a path and, more specifically, resides in the improvement comprising, in combination, the steps of, or means for, providing an elongate guide for the sheet in contact with the drive belt along said path, selectively tilting the guide and thereby the belt on an axis extending in said predetermined direction, effecting a skew adjustment for the sheet by tilting the guide and belt by different angular amounts at each of at least two locations spaced along the elongate guide, driving the belt along said path and tilted guide, and feeding the sheet inbetween the tilted guide and belt for moving the sheet with the drive belt in the path along the tilted guide.

Other aspects of the invention will become apparent in the further course of this disclosure, and no restriction to any specific method, step, apparatus, component or feature is intended by this brief summary of the invention.

The expression "inbetween" is herein employed to signify feeding or traveling of sheets into the space or into or in the location between two objects, such as the traveling belt 16 and bowed guide 20.

BRIEF DESCRIPTION OF THE DRAWINGS

The subject invention and its objects and aspects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
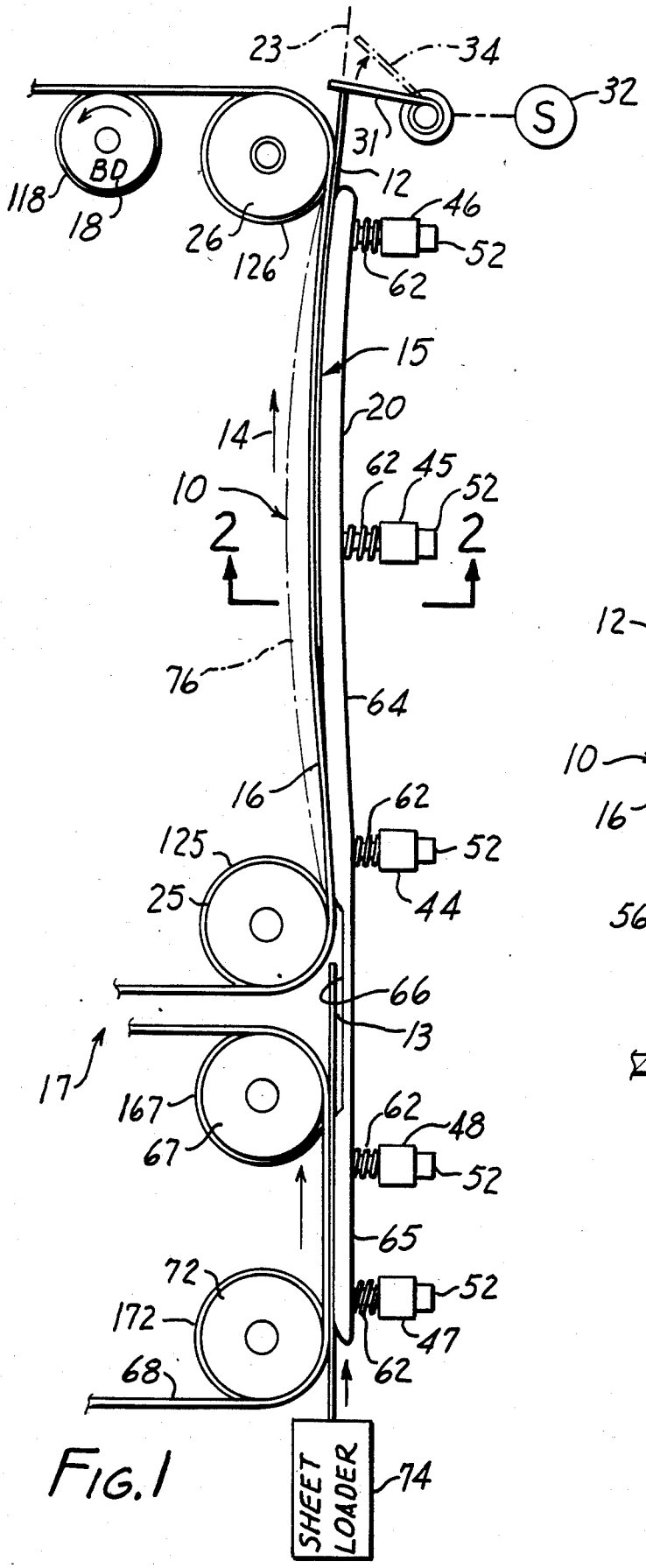
FIG. 1 is a top view of a sheet transport system embodying the subject invention.

The sheet transport system 10 shown in the drawing transports sheet 12 and 13 in a predetermined direction 14 along a path 15. At least one drive belt 16 is provided for driving the sheets along the path 15. Belt 16 may be part of a conventional conveyor system 17 which includes a belt drive 18 comprising the conventional belt drive pulley and motor shown only symbolically at BD.

An elongate guide 20 for each sheet 12 et seq. is provided for initial contact with the drive belt along the path 15. By way of example, the guide 20 may be in the form of a rail or strip of rectangular cross-section, made, for instance, of a plastic material, such as high-molecular weight polyethylene, or of a metal, such as stainless steel. In practice, an electrically conducting material for the guide 20 is preferred where the bleeding off of static electricity from the advancing sheets is important.

Figure 2:
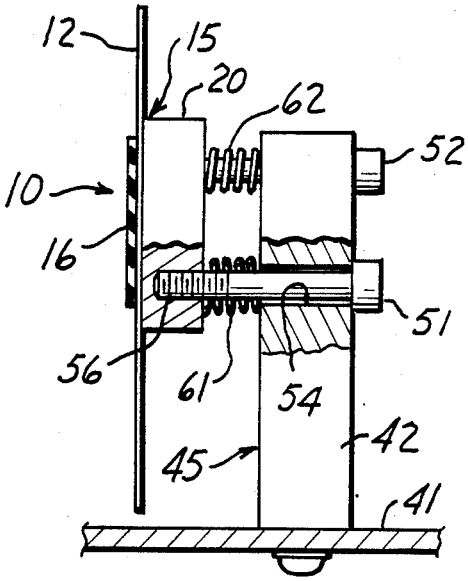
FIG. 2 is a view taken on the line 2—2 in FIG. 1, on an enlarged scale.
Figure 3:
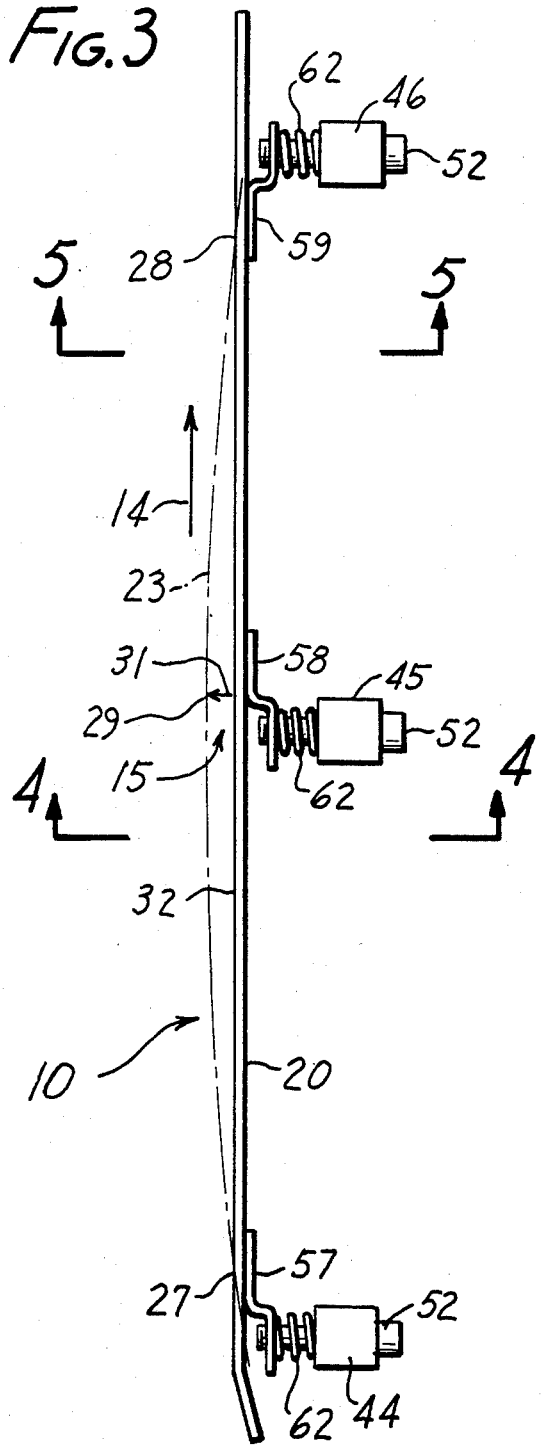
FIG. 3 illustrates a modification that may be employed in the embodiments of FIGS. 1 and 2.
Figure 4:
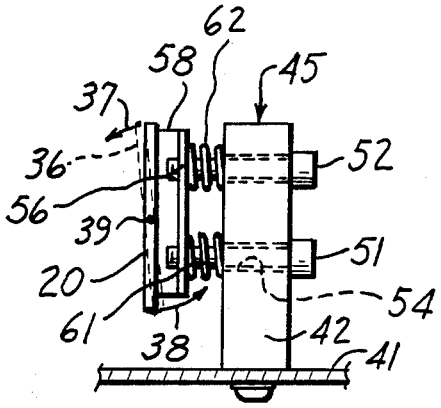
FIG. 4 is a view taken on the line 4—4 in FIG. 3, on an enlarged scale.

The guide 20, shown primarily in FIGS. 1 and 2, may be thinner, as shown by way of example in FIGS. 3 and 4. In either case, however, the guide 20 is of sufficient thinness so as to be flexible for the purposes presently described.

In particular, as shown by way of example in FIG. 3, the guide 20 is bowed along an arc 23 extending into the path 15 in parallel to the predetermined direction of sheet advance 14. Of course, if the guide 20 is bowed, the direction of sheet advance may be considered to be bowed correspondingly. However, even if the direction of sheet advance 14 is considered to be straight, the arc 23 still extends into the path 15 substantially in parallel to that predetermined direction 14.

In FIGS. 3 and 4, any showing of the belt conveyor system 17 has been omitted in order to permit a better showing of the arc 23 in FIG. 3 and of the guide tilting in FIG. 4, more fully described below. However, it is to be understood that at least the sheet drive belt 16 and belt drive 18 are used in the sheet transport of FIGS. 3 and 4 as well. In either case, the belt support pulleys 25 and 26 preferably are located ahead of and after the guide 20, respectively, so that the curvature of the arc 23 may readily be realized for that guide without impediment by belt support or guide pulleys. In other words, where the belt is supported or runs over spaced pulleys, the guide 20 preferably is situated between such pulleys, rather than extending over the point of contact between pulley and belt.

Even though the arc 23 could not be shown in FIGS. 1 and 2, while the belt 16 could not be shown in FIGS. 3 and 4 without obliterating that arc, it should be clear that the bowing of the guide 20 along the arc 23 bows the drive belt 16 in the embodiment of FIGS. 3 and 4 as well as in the embodiment of FIGS. 1 and 2. Also in both of these embodiments, the bowed belt 16 is driven along the path 15, such as with the belt drive 18, for moving the sheets 12 et seq. with that bowed drive belt in the path 15 along the bowed guide 20.

In accordance with the illustrated preferred embodiment of the subject invention, the sheet guide is bowed by retaining that elongate guide 20 at two locations 27 and 28 spaced along the sheet advance path and by pushing the guide into that path 15 at a region or point 29 situated between the two locations 27 and 28.

As shown in FIG. 3. for the embodiments of FIGS. 1 to 4, the guide 20 is retained at the point 29 at such a height 31 of the arc 23 relative to a span 32 of that arc between the two locations 27 and 28, as realized by the above mentioned pushing of the guide into the path 15. In other words, after the guide 20 has been pushed into the sheet transport path 15 by the amount at 31 necessary for realizing the guide curvature at 23, then the guide may be retained at the realized height 31 of its arc 23.

The ratio of the height 31 to the distance between the location 27 and 28 or span 32 may be referred to as the pitch of the arc 23 and thereby of the curvature of the guide 20. In a sense, bowing of the guide 20 into the path 15 may be considered an adjustment of the yaw of the traveling sheets, since the resulting longitudinal trajectory of the traveling sheets 12 et seq. thereby form an angle relative to the direction 14 of sheet transport for the straight sheet guide 20 shown in solid outlines in FIG. 3.

As shown in FIG. 1, a selectively releasable gate 31 is provided at the path 15 for selectively stopping a moving sheet 12 et seq. in that path. That or other means for stopping a moving sheet in the path and for subsequently releasing such stopped sheet for movement with the driven belt 16 further along that path 15, may be employed in all illustrated embodiments of the subject invention, even though only shown in FIG. 1. Reference may in this respect be had to the above mentioned U.S. Pat. No. 4,362,298 by Rafn Stefansson et al, hereby incorporated by reference herein, which, at 67, shows a gate of the type of gate 31 shown herein, actuated between closed and open positions by a solenoid or actuator of the type shown herein at 32, in response to conventional control signals.

According to a preferred embodiment of the subject invention, the belt drive 18 continues to drive the belt 16 along the path 15 both if the gate 31 is releasing the sheet for movement along its path and also if the gate is stopping the sheet in that path. In other words, the drive 18 drives the bowed drive belt 16 also along a stopped sheet, so that each stopped sheet 12 et seq. will start to move immediately with the driven belt 16 further along the path 15 when the gate 31 is actuated to its open position, as shown in dotted outline at 34 in FIG. 1.

Under normal circumstances, this would cause the drive belt to wear on the stopped sheet and to buckle up or otherwise overdrive the stopped sheet. However, if the teachings according to the currently discussed embodiment of the subject invention are followed, no damage to the stopped sheet or to the sheet transport occurs, even if the bowed drive belt 16 is driven along the stopped sheet until the gate 31 releases that sheet.

In particular, the guide 20 is retained at the point 29 at such a height 31 of the arc 23 relative to the span 32 of the arc between the two locations 27 and 28, as required to permit the bowed drive belt 16 to be driven along the stopped sheet until the gate 31 releases that sheet, and to enable the bowed drive belt to move that sheet through the gate when such gate releases that sheet.

Location of the gate 31 relative to the guide 20 will somewhat depend on the size or thickness of the sheet 12. However, if there is any danger that the sheet could warp or buckle between the end of the guide and the gate, when that gate is closed, then the gate can be moved closer to the guide as, for instance, shown for the sheet support surface and the associated gate in the sheet transport of the above mentioned U.S. Pat. No. 4,362,298, by Rafn Stefansson.

It is also a special feature of embodiments of the subject invention that the correct curvature and pitch of the bow of the guide 20 for different sizes and kinds of sheets can easily be determined by adjustment, as more fully disclosed below.

Figure 5:
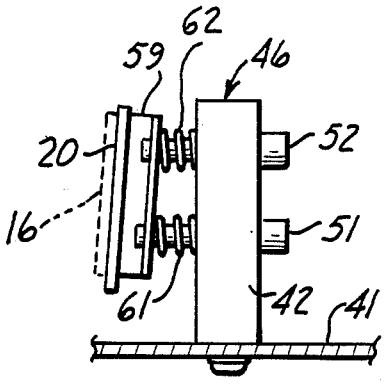
FIG. 5 is a view taken on the line 5—5 in FIG. 3 on an enlarged scale.

This applies also to another feature of the illustrated preferred embodiments of the invention, according to which the guide 20 and thereby the drive belt 16 can be selectively tilted on an axis extending in the predetermined direction 14 of sheet advance. This feature is specifically illustrated with the aid of FIGS. 4 and 5 for the embodiment shown in FIG. 3, but is equally employed in the embodiment of FIGS. 1 and 2. In this respect, as shown in FIGS. 4 and 5, the guide 20 is tilted differently at different regions thereof. For instance, as illustrated in FIG. 4, a first tilt, illustrated by a dotted line 36, and a torque couplet 37 and 38, is imposed on the guide 20 at the point 29 about an axis 39 extending in, or parallel to, the predetermined direction 14 of sheet or belt advance and, therefore, appearing in FIG. 4 as a point at 39.

Any suitable means or technique may be employed for retaining the traveling drive belt on the drive and guide rollers. For instance, as shown at 118, 125, 126, 167 and 172, these rollers may be crowned or given a convex configuration for that purpose.

As seen in FIG. 5, a second tilt which is different from the first tilt shown in FIG. 4, is imposed on the guide 20 at another portion thereof, such as at either of the two locations 27 and 28. Again, by adjusting the various tilts along the guide 20, a specific trajectory of sheet advance can be established along the path 15 for various sizes and kinds of sheets.

Means for effecting all kinds of guide curvatures and tilts according to embodiments of the subject invention are illustrated in the drawings. In this respect, a baseplate 41 for the sheet transport 10, is shown only partially in FIGS. 2, 4, and 5, so as not to confuse the showing of FIGS. 1 and 3. An upright post 42 is attached to the baseplate for each guide adjusting and retention device 44, 45, 46, 47 and 48 in terms of orientation, the posts 42 may be considered as extending vertically, while the sheet path 15, the direction of sheet travel 14, and the baseplate 41 may be considered as extending horizontally. In fact, part of the baseplate 41 may serve as a registration surface for the traveling sheet 12, but a separate registration edge may also be employed, as disclosed in the above mentioned incorporated U.S. Pat. No. 4,362,298, by Rafn Stefansson et al.

Each device 44 to 48 has a pair of lower and upper adjustment screws 51 and 52 extending preferably in parallel to the baseplate 41 or horizontally in the general orientation illustrated in FIGS. 1 to 5. The screws 51 and 52 are vertically spaced from each other, extending through corresponding holes in the posts 42, one of which is seen at 54 in FIG. 2

The screws 51 and 52 extend into corresponding threaded holes in the guide 20 or in a bracket attached thereto. For instance, as shown in FIG. 2, the threaded hole 56 may be located directly in the guide 20. Alternatively, as shown in FIGS. 3 to 5, the screws 51 and 52 cooperate with brackets 57, 58, and 59 which are attached to a back side of the guide 20. In that case, holes of the type of the threaded hole 56 shown in FIG. 2 are provided in the brackets 57 to 59 so as to receive the threaded ends of the adjustment screws 51 and 52.

The guide 20 is maintained in spaced relationship to each post 42 by resilient means, such as coiled springs 61 and 62 extending individually around screws 51 and 52 and acting on the guide 20 or brackets 57 to 58 relative to the post 42.

By way of example, the devices 44 and 46 retain the elongate guide 20 at the two locations 27 and 28 spaced along the path 15, while such guide is pushed into that path by adjustment of the screws of the central device 45 substantially at a point 29 situated between the two locations 27 and 28. The springs 61 and 62 then cooperate with the screws 51 and 52 in the device 45 in retaining the guide 20 at the point 29 at the height 31 of the arc 23 relative to the span of the arc between locations 27 and 28. This manner, the guide 20 may be given any desired curvature for optimum belt-to-sheet contact in the path 15 for any kind of sheet material and dimension, and for optimum belt-to-guide contact before a sheet is inserted therebetween.

The screws 51 and 52 may be rotated differently or by different amounts at each post 42, so as to impose any desired tilt on the guide 20.

Each of the devices 44 to 48, or any combination thereof, may be employed either for imposing on the guide 20 only a curvature, as illustrated at 23, or only a tilt, as illustrated in FIGS. 2, 4, and 5. However, according to the preferred embodiment shown in FIGS. 3 to 5, both a curvature along an arc 23 and tilts transversely thereto are realized for the guide 20 in a combined manner. This also applies to the section 64 of the guide 20 shown in FIG. 1. However, that guide 20 also has a second section 65 which is spaced from the first guide section 64 by a recess 66.

In other words, the elongate guide 20 according to FIG. 1 is provided with a recess 66 between two sections 64 and 65 of that guide. The recess 66 is a relief area, which eliminates pressure on any belt pulleys, including the pulley 25 and a pulley 67 for a sheet drive belt 68. In this respect, a sheet drive belt 68 extends over the pulley 67 and a pulley 72 and the screws of the devices 47 and 48 are adjusted so as to apply the guide section 65 to the belt 71 for the transport of a sheet 13 when inserted therebetween.

In practice the belt 68 may be separate from, or combined with, the belt 16 and may be driven separately from, or by the same belt drive 18 as the belt 16, depending on the requirements of a given sheet transport.

The recess 66 preferably is sufficient to prevent curvatures and tilts imposed in the section 64 to be transmitted to the section 65 of the guide 20, and vice versa. In fact, for short sections of the guide 20, such as the section 65, only the tilt of the guide need be adjusted, without imposition of a curvature, such as the curvature shown for the larger section 64 in FIG. 1 or for the entire guide 20 in FIG. 3. Accordingly, as little as one adjustment device may be provided for very short guide sections. If two adjustment devices 47 and 48 are provided for a relatively short guide section, such as shown for the section 65 in FIG. 1, then those two devices may still be employed for adjusting the yaw of that guide section about a vertical axis, in addition to imposing different tilts relative to a vertical plane.

In practice, the guide sections 64 and 65 may be employed for different tasks in the sheet transport path. For instance, the section 65 may be employed as a sheet entry section for guiding each entering sheet to the main section 64 which imposes the yaw and pitch on each sheet as required for entry into further sheet handling or data transferring and processing equipment.

Within the scope of the subject invention, the sections 64 and 65 may be separate from each other and may contact portions of the same belt 16 or of different sheet advance belts 16 and 68.

Reference may, for instance, be had in this respect to the above mentioned U.S. Pat. No. 4,514,799, by William H. Spencer et al, incorporated by reference herein, which illustrates the need for transporting various sheets or documents between data transfer and processing stations, including cameras, optical character readers, print heads, date endorsers, read heads and other stations, particularly in a remittance processing terminal in which various payment checks and remittance stubs are received in rapid succession.

In such or other apparatus, the transports according to the subject invention and embodiments thereof may be employed in addition to or in lieu of the angular-linear sheet transports shown in the above mentioned incorporated U.S. Pat. No. 4,362,298 by Rafn Stefansson et al. As shown by box 74, that angular-linear sheet transport may be employed for loading the documents into the sheet transport system 10 shown in FIGS. 1 and 2 or in FIGS. 3 to 5 hereof.

Alternatively, sheet transports of the type herein disclosed may, for instance, be employed in the reproducing machine shown in the above mentioned U.S. Pat. No. 4,533,135, by Laurence S. Barker, or in the collator shown in the above mentioned U.S. Pat. No. 3,998,453 by Wilfried Dorer, both of which patents are herewith incorporated by reference herein.

The sheet transports according to the subject invention and the embodiments thereof may also be employed in industrial applications, such as in the type of situation referred to in the above mentioned U.S. Pat. No. 3,861,516 Tadao Inose et al, hereby incorporated by reference herein, and referring to the feeding of sheets into a punching machine.

As indicated in FIG. 1 by the sheet loader block 74, for the embodiments of FIGS. 1 to 5, the sheets are fed inbetween the bowed guide 20 and belt 68 and thereafter belt 16 for moving each sheet with the bowed drive belt 16 in the path 15 along the bowed guide 20. Of course, as to the embodiment of FIG. 1, it may alternatively be said that the moving belt 68 feeds the sheets inbetween the bowed guide 20 and the belt 16.

In both illustrated embodiments of the subject invention, the arc 23 may be varied in pitch or the guide 20 may be varied in curvature, as shown at 76 in FIG. 1, for different sheets, such as sheets of different thickness, stiffness, or texture.

This may, for instance, easily be done in the illustrated embodiments by readjusting the screws 51 and 52 of the device 45 or even by readjusting screws 51 and 52 in either or both of the outer devices 44 and 46.

In addition to the yaw adjustment thus effected, a skew adjustment may be provided for the traveling sheet. According to the different aspects of the subject invention, such a skew adjustment may be effected even where no yaw adjustment is desired or necessary.

By way of example, FIG. 1 shows tilt or skew adjusting devices 47 and 48 that may be employed for a guide section or an entire guide in which no bow adjustment or even no bow is imposed at all. For instance, the guide section 65 may for present purposes be considered as a separate guide, without any connection to the guide 64. In that case, the recessed portion 66 may be omitted.

According to the latter aspect of the subject invention, an elongate guide 65 for the sheets 12, 13, et seq. is provided in contact with the drive belt 68 along the sheet advance path. This aspect of the invention again selectively tilts the guide 65 and thereby the belt 68 on an axis extending in the predetermined direction of sheet advance. This kind of axis is shown at 39 in FIG. 4 in parallel to the direction of sheet advance 14.

Skew adjustments for the sheet are then effected by tilting the guide and belt by different angular amounts at each of at least two locations spaced along that elongate guide. This as such has already been discussed above in connection with FIGS. 4 and 5. In our present example, first means are connected to the guide at the first location for imposing on that guide a first adjustable tilt on an axis extending in the predetermined direction of sheet advance. In terms of FIG. 1, such first adjustable tilt may be effected by the first device 47, while such first adjustable tilt may be effected in the embodiment of FIGS. 3 to 5 by the device 45 which is connected to the guide 20 at a first location 29 for imposing on that guide a first adjustable tilt on an axis 39 extending in the predetermined direction 14.

Second means are also connected to the guide at a second location spaced along the guide from the first location for imposing on the guide a second adjustable tilt independent of the first tilt. In FIG. 1, the second device 48, connected to the guide 65 at a second location spaced along that guide from the first location, may be employed for that purpose, while in the embodiment of FIGS. 3 to 5 such second means may, for instance, comprise the device 46 which imposes on the guide 28 second adjustable tilt, as illustrated in FIG. 5, independently of the first tilt shown in FIG. 4 at 36.

In either case, sheets are fed inbetween the tilted guide 20 or 65 and belt 16 or 68 for moving the sheet with the drive belt in the path along the tilted guide 20 or 65. As indicated by way of example in FIG. 1, a sheet loader 74 may be employed for that purpose.

In practice, very accurate and versatile skew adjustment may be effected for each advancing sheet in this manner. For instance, the lower edge of the sheet 12 may be lifted off the baseplate 41 by any amount desired or necessary for a given purpose. In practice, this feature is important in the case of equipment that requires a specific entry level of documents or other sheets. By way of example, most magnetic ink character recognition (MICR) printers and readers require for perfect operation an exact entry level of each document to be handled thereby. According to the illustrated preferred embodiment of the invention seen in FIG. 2, the traveling sheet 12 is maintained spaced from the baseplate 41 by a predetermined distance during movement of that sheet with the bowed drive belt 16 in the path 15 along the bowed guide 20. That predetermined distance of the moving sheet 12 from the baseplate 41 is established and maintained by selective tilting of the guide 20 and thereby of the belt 16 on an axis 39 extending in the predetermined direction 14.

As apparent from the drawings, the guides 20 according to the illustrated preferred embodiments of the invention are straight in a direction transverse to the direction of sheet advance 14 or to the direction in which the arc or curvature 23 or 76 extends, both as to its height 31 or to its span 32. Also, advancing sheet 12 contacts the guide 20 across its entire width, as has been shown in FIG. 2, by way of example. In this respect, the sheet 12 may be curved somewhat along the arc 23 or 76, as it travels along the guide curvature, but no sheet is bent or warped transversely as it would in the belt conveyor of the above mentioned Needham U.S. Pat. No. 2,028,236, or bent and even warped longitudinally and transversely, as in the drag conveyor shown in the above mentioned Griffith U.S. Pat. No. 1,786,343. That kind of bending and warping would be unacceptable in remittance processing and microprocessor systems of the type shown in the above mentioned Spencer et al U.S. Pat. No. 4,514,799 or in other equipment requiring a delicate orientation of sheets advancing therethrough.

In fact, systems according to the subject invention, are capable of perfectly transporting torn-off remittance stubs and similar items with ragged edges, as well as all kinds of payment checks, with perfect precision. A reason therefore according to the illustrated preferred embodiments of the invention is that the pitch of the arc 23 or curvature of the guide 20 is variable for different sheets, as indicated by way of example at 76 in FIG. 1.

Also, the guides 20 according to the illustrated preferred embodiments are not twisted or contorted, unlike the guide member of the above mentioned Fertig U.S. Pat. No. 3,052,467, there serves to direct documents diverted from the main feed path into a stacking area extending at an acute angle thereto.

The subject extensive disclosure will render apparent or suggest to those skilled in the art various modifications and variations within the spirit and scope of the subject invention and equivalents thereof.

I claim:

1. In a method of transporting a sheet with a drive belt in a predetermined direction along a path, the improvement comprising in combination the steps of:

providing an elongate guide for said sheet in contact with said drive belt along said path;

bowing said guide along an arc extending into said path in parallel to said predetermined direction and thereby bowing said drive belt;

driving said bowed belt along said path and bowed guide; and feeding said sheet inbetween said bowed guide and belt for moving said sheet with said bowed drive belt in said path along said bowed guide.

2. A method as claimed in claim 1, including the step of:

varying said arc in pitch for different sheets.

3. A method as claimed in claim 1, including the steps of:

providing said elongate guide with a recess between two sections of said guide for spacing said guide from said drive belt at said recess; and effecting said bowing of the guide along said arc in either of said sections.

4. A method as claimed in claim 1, including the step of:

selectively tilting said guide and thereby said belt on an axis extending in said predetermined direction.

5. A method as claimed in claim 4, wherein:

said guide is tilted by different angular amounts at each of at least two locations spaced along said elongate guide.

6. A method as claimed in claim 1, including the step of:

maintaining said sheet spaced from a baseplate by a predetermined distance during movement of said sheet with said bowed drive belt in said path along said bowed guide.

7. A method as claimed in claim 6, including the step of:

establishing and maintaining said predetermined distance of the moving sheet from said baseplate by selective tilting of said guide and thereby said belt on an axis extending in said predetermined direction.

8. A method as claimed in claim 1, including the steps of:

stopping said moving sheet with a selectively releasable gate at said path, but driving said bowed drive belt along said stopped sheet; and subsequently releasing said stopped sheet for movement with said driven belt further along said path.

9. A method as claimed in claim 8, wherein:

said bowed drive belt is driven along said stopped sheet until said gate releases said sheet.

10. A method as claimed in claim 1, wherein:

said guide is bowed by retaining said elongate guide at two locations spaced along said path and pushing said guide into said path at a point situated between said two locations.

11. A method as claimed in claim 10, including the step of:

retaining said guide at said point at such a height of said arc relative to a span of said arc between said two locations, as realized by said pushing of the guide into said path.

12. A method as claimed in claim 10, including the step of:

imposing on said guide at said point a first tilt on an axis extending in said predetermined direction; and imposing on said guide at either of said two locations a second tilt which is different from said first tilt.

13. A method as claimed in claim 10, including the steps of:

providing a selectively releasable gate at said path for selectively stopping said moving sheet in said path;

continuing to drive said belt along said path both if said gate is releasing said sheet for movement along said path and also if said gate is stopping said sheet in said path; and retaining said guide at said point at such a height of said arc relative to said span of said arc between said two locations, as required to permit said bowed drive belt to be driven along said stopped sheet until said gate releases said sheet, and to enable said bowed drive belt to move said sheet through said gate when said gate releases said sheet.

14. A method as claimed in claim 13, including the step of:

selectively tilting said guide and thereby said belt on an axis extending in said predetermined direction.

15. A method as claimed in claim 14, wherein:

said guide is tilted by different angular amounts at each of said two locations and at said point situated between said two locations.

16. In a method of transporting a sheet with a drive belt in a predetermined direction along a path, the improvement comprising in combination the steps of:

providing an elongate guide for said sheet in contact with said drive belt along said path;

selectively tilting said guide and thereby said belt on an axis extending in said predetermined direction;

effecting a skew adjustment for said sheet by tilting said guide and belt by different angular amounts at each of at least two locations spaced along said elongate guide;

driving said belt along said path and tilted guide; and feeding said sheet inbetween said tilted guide and belt for moving said sheet with said drive belt in said path along said tilted guide.

17. A method as claimed in claim 16, including the step of:

establishing and maintaining a predetermined distance of the moving sheet from a baseplate by said tilting of said guide and belt by different angular amounts.

18. In apparatus for transporting a sheet in a predetermined direction along a path, the improvement comprising in combination:

a drive belt for driving said sheet along said path;

an elongate guide for said sheet in contact with said drive belt along said path;

means for bowing said guide along an arc extending into said path in parallel to said predetermined direction and thereby bowing said drive belt;

means for feeding said sheet inbetween said bowed guide and belt; and means for driving said bowed belt along said path for moving said sheet with said bowed drive belt in said path between said bowed guide and belt.

19. Apparatus as claimed in claim 18, including:

means for stopping said moving sheet in said path and for subsequently releasing said stopped sheet for movement with said driven belt further along said path, including a selectively releasable gate at said path;

said means for driving said bowed belt include means for continuing to drive said bowed drive belt along said stopped sheet.

20. Apparatus as claimed in claim 18, including:

first means for selectively tilting said guide and thereby said belt on an axis extending in said predetermined direction; and second means spaced from said first means for tilting said guide independently of said first means so that said guide is tiltable by different angular amounts at each of at least two locations spaced along said elongate guide.

21. Apparatus as claimed in claim 18, wherein:

said elongate guide has a recess between two sections of said guide for spacing said guide from said drive belt at said recess; and said guide has a curvature extending along said arc in either of said sections.

22. Apparatus as claimed in claim 18, including:

means for selectively tilting said guide and thereby said belt on an axis extending in said predetermined direction.

23. Apparatus as claimed in claim 18, including:

means connected to said guide for varying said arc in pitch for different sheets.

24. Apparatus as claimed in claim 18, wherein:

said guide has a curvature extending along said arc.

25. Apparatus as claimed in claim 24, including:

means for varying said curvature for different sheets.

26. Apparatus as claimed in claim 18, including:

means for maintaining said sheet spaced from a baseplate by a predetermined distance during movement of said sheet with said bowed drive belt in said path along said bowed guide.

27. Apparatus as claimed in claim 26, wherein.

said means for establishing and maintaining said predetermined distance of the moving sheet from said baseplate include means for selectively tilting said guide and thereby said belt on an axis extending in said predetermined direction.

28. Apparatus as claimed in claim 18, wherein:

said means for bowing said guide include means for retaining said elongate guide at two locations spaced along said path and means for pushing said guide into said path at a point situated between said two locations.

29. Apparatus as claimed in claim 28, wherein:

said means for pushing said guide include means for retaining said guide at said point at such a height of said arc relative to a span of said arc between said two locations, as realized by said pushing of the guide into said path.

30. Apparatus as claimed in claim 28, including:

a selectively releasable gate at said path for selectively stopping said moving sheet in said path;

said driving means including means for continuing to drive said belt along said path both if said gate is releasing said sheet for movement along said path and also if said gate is stopping said sheet in said path; and said pushing means include means for retaining said guide at said point at such a height of said arc relative to span of said arc between said two locations, as required to permit said bowed drive belt to be driven along said stopped sheet until said gate releases said sheet, and to enable said bowed drive belt to move said sheet through said gate when said gate releases said sheet.

31. Apparatus as claimed in claim 28, wherein:

said pushing means include means for imposing on said guide at said point a first tilt on an axis extending in said predetermined direction; and said means for retaining said elongate guide at said two locations include means for imposing on said guide at either of said two locations a second tilt which is different from said first tilt.

32. Apparatus as claimed in claim 28, including:

means for selectively tiltinq said guide and thereby said belt on an axis extending in said predetermined direction.

33. Apparatus as claimed in claim 32, wherein:

said means for pushing said guide include means for retaining said guide at said point at such a height of said arc relative to a span of said arc between said two locations, as realized by said pushing of the guide into said path.

34. In apparatus for transporting a sheet in a predetermined direction along a path, the improvement comprising in combination:

a drive belt for driving said sheet along said path;

an elongate guide for said sheet in contact with said drive belt along said path;

means connected to said guide for effecting a skew adjustment for said sheet, including first means connected to said guide at first location for imposing on said guide a first adjustable tilt on an axis extending in said predetermined direction, and second means connected to said guide at a second location spaced along said guide from said first location for imposing on said guide a second adjustable tilt independent of said first tilt; and means for feeding said sheet inbetween said tilted guide and belt for moving said sheet with said drive belt in said path along said tilted guide.

35. Apparatus as claimed in claim 34, including:

means for establishing and maintaining with said first and second means a predetermined distance of the moving sheet from a baseplate.

* * * * *